US005841413A

United States Patent [19]

Zhu et al.

[11] Patent Number: 5,841,413

[45] Date of Patent: Nov. 24, 1998

[54] METHOD AND APPARATUS FOR MOVING PIXEL DISTORTION REMOVAL FOR A PLASMA DISPLAY PANEL USING MINIMUM MPD DISTANCE CODE

[75] Inventors: Daniel Qiang Zhu, Columbus; Thomas James Leacock, Medford, both of N.J.

[73] Assignee: Matsushita Electric Industrial Co., Ltd., Osaka, Japan

[21] Appl. No.: 874,773

[22] Filed: Jun. 13, 1997

[51] Int. Cl.[6] ..... G09G 3/28

[52] U.S. Cl. ..... 345/63; 345/60; 345/67

[58] Field of Search ..... 345/60, 61, 62, 345/63, 64, 67; 348/797

[56] References Cited

U.S. PATENT DOCUMENTS 5,436,634 7/1995 Kanazawa et al. ..... 345/67

OTHER PUBLICATIONS

Nakamura, T. et al. "Drive for 40 inch Diagonal Full Color AC Plasma Display" vol. XXVI, pp. 807–810 SID International Symposium Digest of Technical Papers, May 1995.

*Primary Examiner*—Richard A. Hjerpe
*Assistant Examiner*—Francis Nghiem Nguyen
*Attorney, Agent, or Firm*—Ratner & Prestia

[57] ABSTRACT

A plasma display device employs a minimum moving pixel distortion (MPD) set of codewords for reducing visually perceived artifacts viewed on a plasma display panel (PDP). The plasma display device includes a minimum MPD mapping process, which maps by, for example, a ROM look-up table, received pixel intensity values into intensity levels corresponding to selected ones of the set of codewords. By increasing the number of subfields (or rounding the least significant bits (LSBs) of the intensity pixels), redundant codewords that express pixel intensities can be generated based on the sustain pulse vector with predetermined constraints. An optimal set of codewords can be determined though (1) a random search; (2) an exhaustive search; (3) dynamic programming or (4) a genetic algorithm based search which minimizes the MPD distance. The mapped codewords are stored in a ROM lookup table as display data by a plasma display controller. The plasma display controller then provides the display data, line by line, to the plasma display panel (PDP) using a scan driver and a data driver. Once the display data is loaded into the PDP for an image, the plasma display controller enables the sustain pulse drivers to illuminate the addressed cells with the intended sustain pulse train encoded by the codeword.

10 Claims, 10 Drawing Sheets

METHOD AND APPARATUS FOR MOVING PIXEL DISTORTION REMOVAL FOR A PLASMA DISPLAY PANEL USING MINIMUM MPD DISTANCE CODE

FIELD OF THE INVENTION

The present invention relates to plasma display device panels and, more particularly, to an apparatus and device for driving same employing a minimum moving pixel distortion (MPD) distance code.

BACKGROUND OF THE INVENTION

Plasma display panels normally use a binary-coded light-emission-period (discharge period) scheme for displaying digital images with certain gray-scale depth. For a typical 6-bit panel (6 bit system), there are $2^6$=64 possible intensity or gray-scale levels. To translate each data bit into a proper light intensity value on the screen, one TV frame period is divided into 6 subfield periods corresponding to bit 0 through bit 5 of a binary-coded decimal pixel intensity. The number of light-emission pulses (sustain pulses) of each discharge period for a cell in the panel varies from 1, 2, 4, 8, 16 to 32 for subfields 1 to 6 respectively. Although this binary-coded scheme is adequate for displaying still images, annoying false contours (contour artifacts) may appear in the image when either a subject within the image moves, or viewer's eyes move relative to the subject. This phenomenon is termed moving pixel distortion (MPD).

In order to address this problem, some systems employ MPD correction with equalization pulses. In this situation, the transition between subfields that may cause a contour artifact is detected and a light emission pulse is added or subtracted before the transition occurs. Other systems may employ a modified binary-coded light-emission method to scatter the contour artifacts. By increasing the number of subfields from, for example, from 6 to 8 in a 6-bit panel, the method redistributes the length of the two largest light-emission blocks into four blocks with equal length (e.g., 16+32=12+12+12+12). To retain the same total number of pulses as used in the traditional system, the number of sustain pulses included in each of these four newly formed blocks is 12 pulses. The contour artifacts that may appear in this modified system are scattered through the image. The result is a more uniform temporal emission achieved by randomly selecting one of the many choices which have the same number of pulses for a given pixel value. When randomization is done at each pixel level, however, the contour artifacts are transformed into moiré-like noise which, in some circumstances, may be a little bit less annoying to the viewer. This form of system only scatters the artifacts, it does not try to minimize them.

SUMMARY OF THE INVENTION

The present invention relates to an apparatus for displaying a sequence of video image frames on a display device, wherein a plurality of subfield periods are defined for each video image frame, each of the subfield periods has a respective illumination level which is applied to the display device, and each video image frame includes a plurality of picture elements (pixels), each pixel being displayed at a respective pixel position on the display device and each pixel having a respective intensity value of a set of intensity values. The apparatus includes a mapping means for mapping the intensity value of each respective pixel into a respective one of a set of minimum MPD codes, wherein at least one combination of subfield periods and respective illumination levels are defined for each one of the set of intensity values to form the set of minimum moving pixel distortion (MPD) codes so as to minimize moving pixel distortion on the display device between successive frames. The apparatus also includes a plasma display means for displaying the sequence of video image frames by using, for each pixel, the respective combination of subfield periods and respective illumination levels produced by mapping each pixel intensity value into the respective defined one of minimum MPD codes.

BRIEF DESCRIPTION OF THE DRAWINGS

These and other features and advantages of the present invention will become apparent from the following detailed description, taken in conjunction with the accompanying drawings, wherein.

DETAILED DESCRIPTION

General Description of Plasma Display Device

Figure 1A:
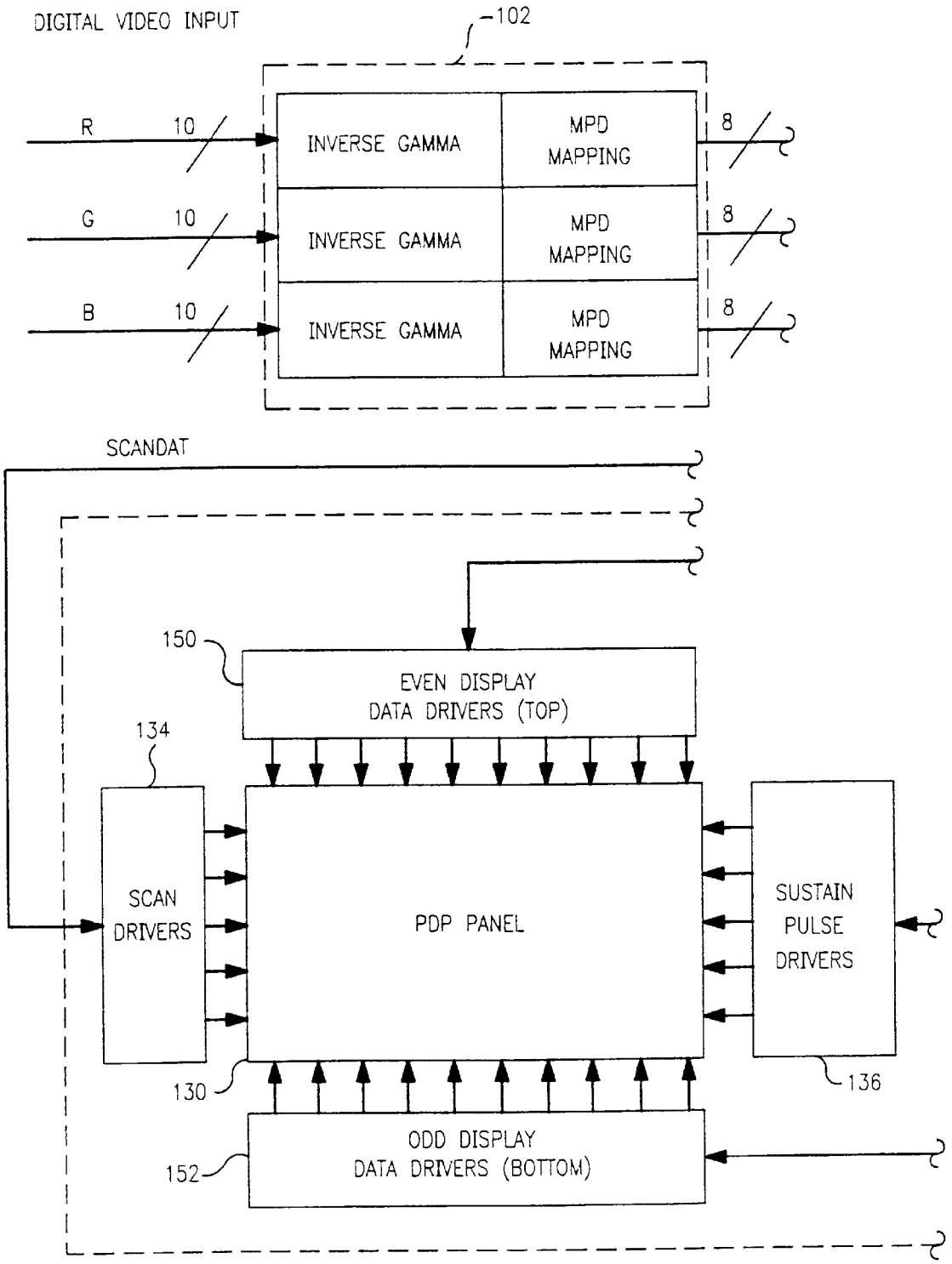
FIGS. 1A and 1B is a high level block diagram of a simplified 8-bit plasma display device as is employed in one embodiment of the present invention.
Figure 1B:
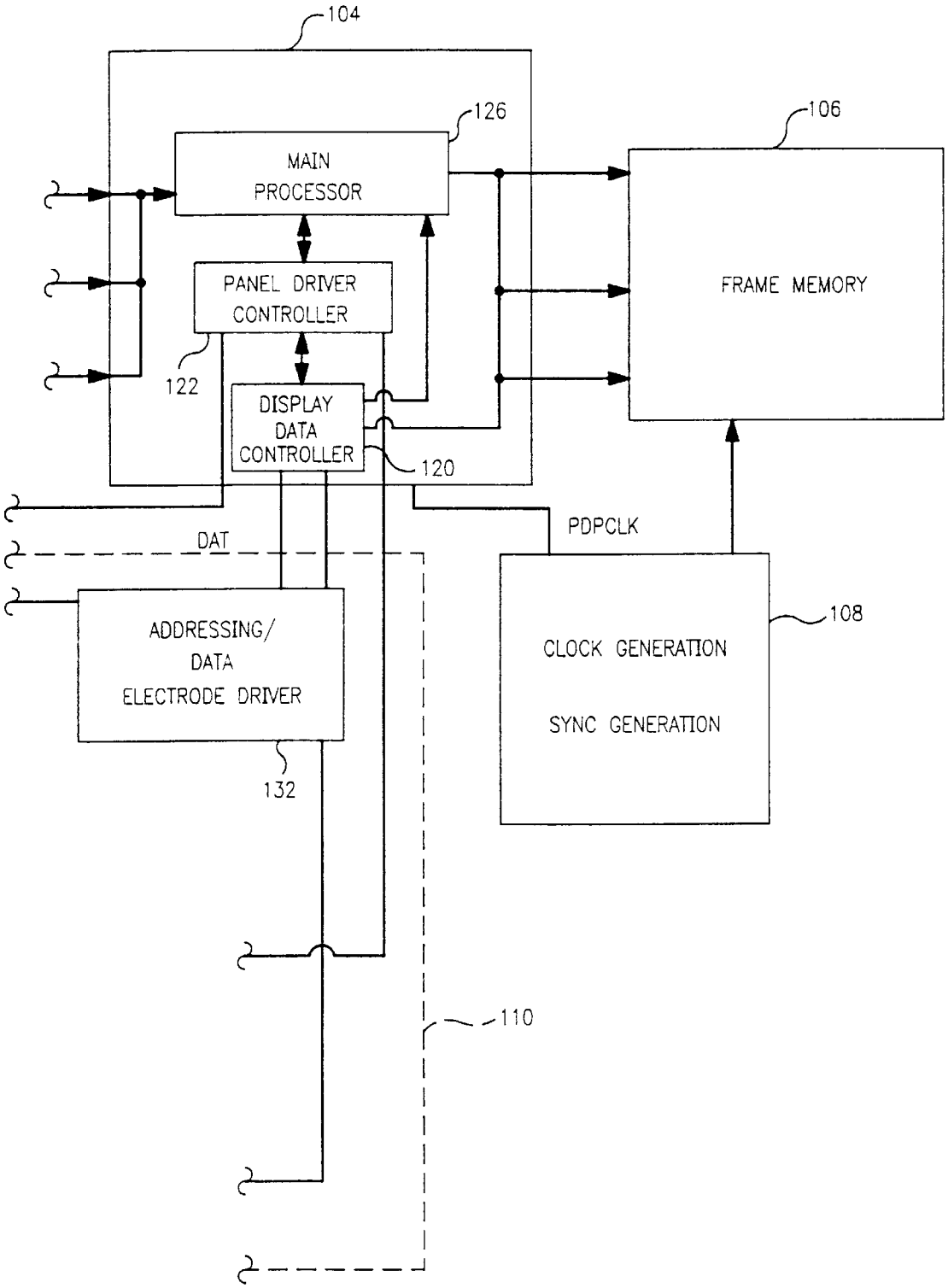

FIG. 1 (shown as FIGS. 1A and 1B) is a simplified block diagram of a plasma display device as is employed in one embodiment of the present invention. As shown, the plasma display device includes Intensity Mapping Processor 102, Plasma Display Controller 104, Frame Memory 106, Clock and Synchronization Generator 108 and Plasma Display Unit 110.

The Intensity Mapping Processor 102 receives, pixel by pixel, digital video input data for a line, pixel by pixel, of a video image frame. The image frame may be of progressive format. For color images, the video input data for each pixel may consist of a Red intensity value, a Green intensity value and a Blue intensity value. For the sake of simplification, the following discussion only assumes one grey scale intensity value is being used. The Intensity Mapping Processor 102 includes, for example, a look-up table or mapping table that translates the pixel intensity value to one of a group of Intensity Levels. Each one of the group of Intensity Levels is defined by a binary codeword. If a binary codeword with eight bits is used to represent these intensity levels, up to 256 intensity levels may be provided, however, the NTSC standard, for example, requires 64 or more intensity levels.

The Intensity Mapping Processor 102 may also include an optional inverse Gamma Correction sub-processor which corrects the intensity value for the visually perceived transfer characteristics of the Plasma Display.

The Frame Memory 106 stores Display Data which is the intensity level for each pixel of a scan line for each line of an frame and a corresponding address for the Plasma Display Unit 110 determined by the Plasma Display Controller 104.

Figure 2A:
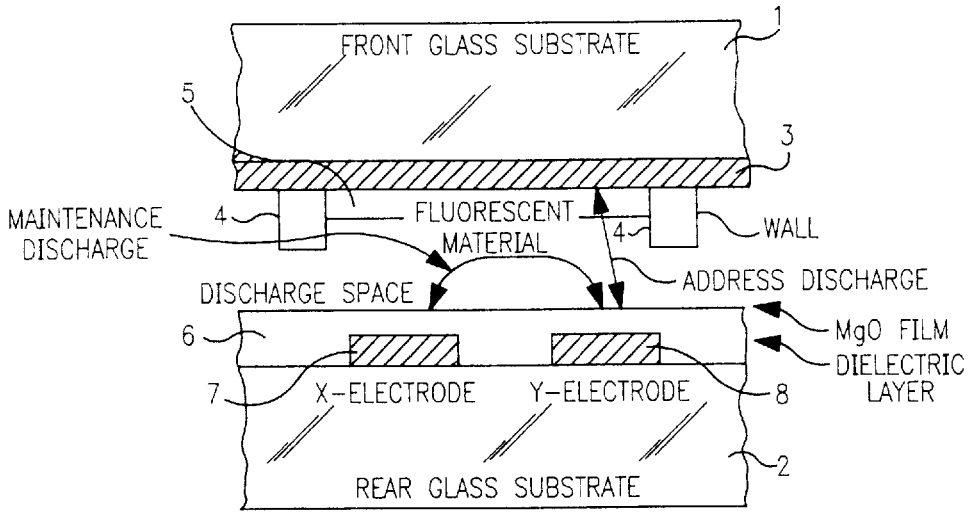
FIG. 2A PRIOR ART
FIG. 2A (Prior Art) is a side plan view of a single cell of a plasma display device which illustrates a cell arrangement of a three electrode surface discharge alternating current PDP as is used in an exemplary embodiment of the present invention.
Figure 2B:
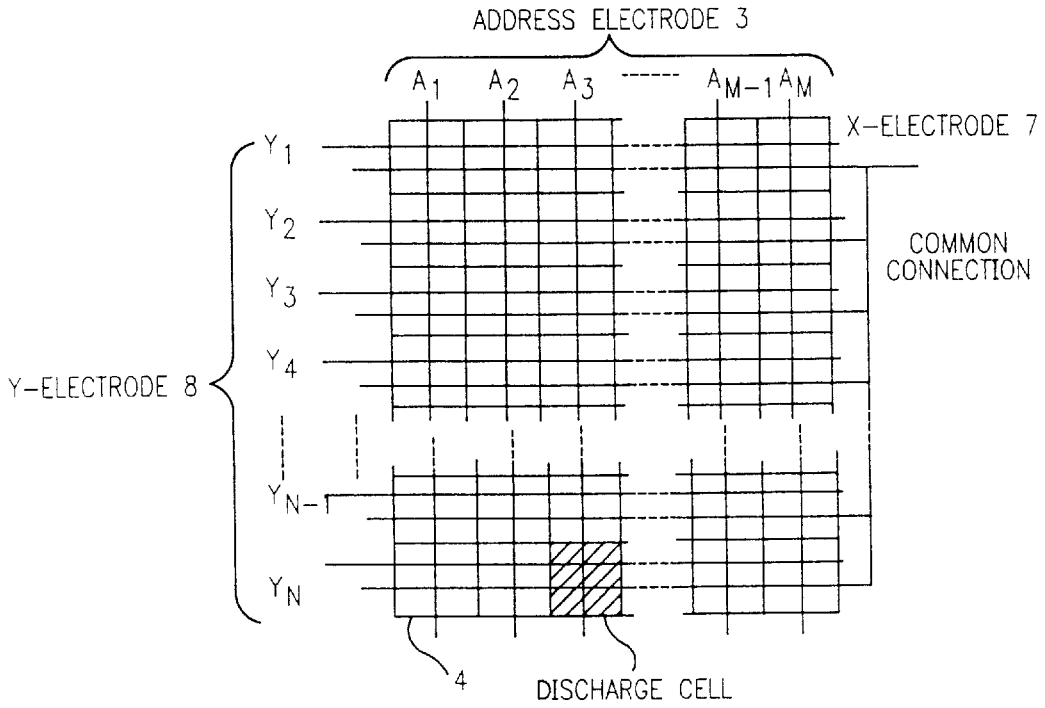
FIG. 2B PRIOR ART
FIG. 2B (Prior Art) is a partial top plan view of a plasma display which illustrates an M×N cell matrix of cells as illustrated in FIG. 2*a*.

The Plasma Display Unit 110 further includes a Plasma Display Panel (PDP) 130, an Addressing/Data Electrode Driver 132, Scan Line Driver 134, and Sustain Pulse Driver 136. The PDP 130 is a display screen formed using a matrix of display cells, each cell corresponding to a pixel value to be displayed. The PDP 130 is shown in more detail in FIG. 2*a* and 2*b*. FIG. 2*a* illustrates an arrangement of a three electrode surface discharge alternating current PDP 130. FIG. 2*b* shows the matrix formed by M×N cells.

As shown in FIG. 2*a,* numeral 1 is a front glass substrate, 2 is a rear glass substrate, 3 is an addressing electrode, 4 is a wall, 5 is a fluorescent material deposited between the walls, 6 is a dielectric layer, and 7 and 8 are the X- and Y-electrodes which are maintenance electrodes. Light emission (by electrical discharge in the presence of the fluorescent material) is accomplished through application of Sustain Pulses (also known as sustain or maintenance discharges) between the X- and Y-electrodes. To select cells corresponding to display data, the addressing electrodes 3 corresponding to the cells are selected to cause a discharge to be deposited against the corresponding cell's Y-electrode. The walls 4 define the discharge space for a cell, and as shown in FIG. 2*b,* the Y-electrodes are selected through the addressing electrodes 3, and the X-electrodes are connected together.

The Addressing/Data Electrode Driver 132 (shown in FIG. 1) receives the Display Data for each line of the scanned image from the Frame Memory 106. As shown, the exemplary embodiment includes Addressing/Data Electrode Driver 132 which may also include an Even Display Data Driver 150 for the even number scan lines of the image, and an Odd Display Data Driver 152 for the odd numbered scan lines of the image. By enabling the Addressing/Electrode Driver 132 to process even and odd scan lines separately, the time to retrieve and load data may be reduced. However, the present invention is not so limited, and a single Addressing/Data Electrode Driver 132 receiving even and odd scan lines sequentially may also be used. Display Data consists of each cell address corresponding to each pixel to be displayed, and the corresponding intensity level codeword (determined by the Intensity Mapping Processor 102).

The Scan Line Driver 134, responsive to control signals from the Plasma Display Controller 104, is used to sequentially select each line of cells corresponding to the scanning line of the image to be displayed. The Scan Line Driver 134 works with the Addressing/Data Electrode Driver 132 to erase and prepare each cell for illumination by the Sustain Pulse Driver 136.

The Sustain Pulse Driver 136 is used to provide the train of sustain pulses for maintenance discharge corresponding to the selected display data value. As shown previously, the X electrodes of the PDP are tied together. The Sustain Pulse Driver 136 applies sustain pulses for a period of time (maintenance discharge period) to all cells for all scan lines; however, only those cells will experience a maintenance discharge which have the Y-electrode addressed by the Addressing/Data Electrode Driver 132.

The Plasma Display Controller 104 further includes a Display Data Controller 120, a Panel Driver Controller 122, Main Processor 126 and optional Field/Frame Interpolation Processor 124. The Plasma Display Controller 104 provides the general control functionality for the elements of the plasma display unit.

The Main Processor 126 is a general purpose controller which administers various input/output functions of the Plasma Display Controller 104, calculates a cell address corresponding to the received pixel address, receives the mapped intensity levels of each received pixel, and stores these values in Frame Memory 106 for the current frame. The Main Processor 126 may also interface with the optional Field/Frame Interpolation Processor 124 to convert stored fields into a single frame for display.

The Display Data Controller 120 retrieves stored Display Data from the Frame Memory 106 and transfers the Display Data for a scan line to the Addressing/Data Electrode Driver 132 responsive to a drive timing clock signal from the Clock and Synchronization Generator 108.

The Panel Driver Controller 122 determines the timing for selecting each scan line, and provides the timing data to the Scan Line Driver 134 in concert with the Display Data controller transferring the Display Data for the scan line to the Addressing/Data Electrode Driver 132. Once the Display Data is transferred, the Panel Driver Controller 122 enables the signal for the Y-electrodes for each scan line to ready the cell for the maintenance discharge.

To facilitate an understanding of the method of the present invention, the use of binary codewords for representing intensity levels of the pixels as is known in the prior art is now described.

Figure 3:
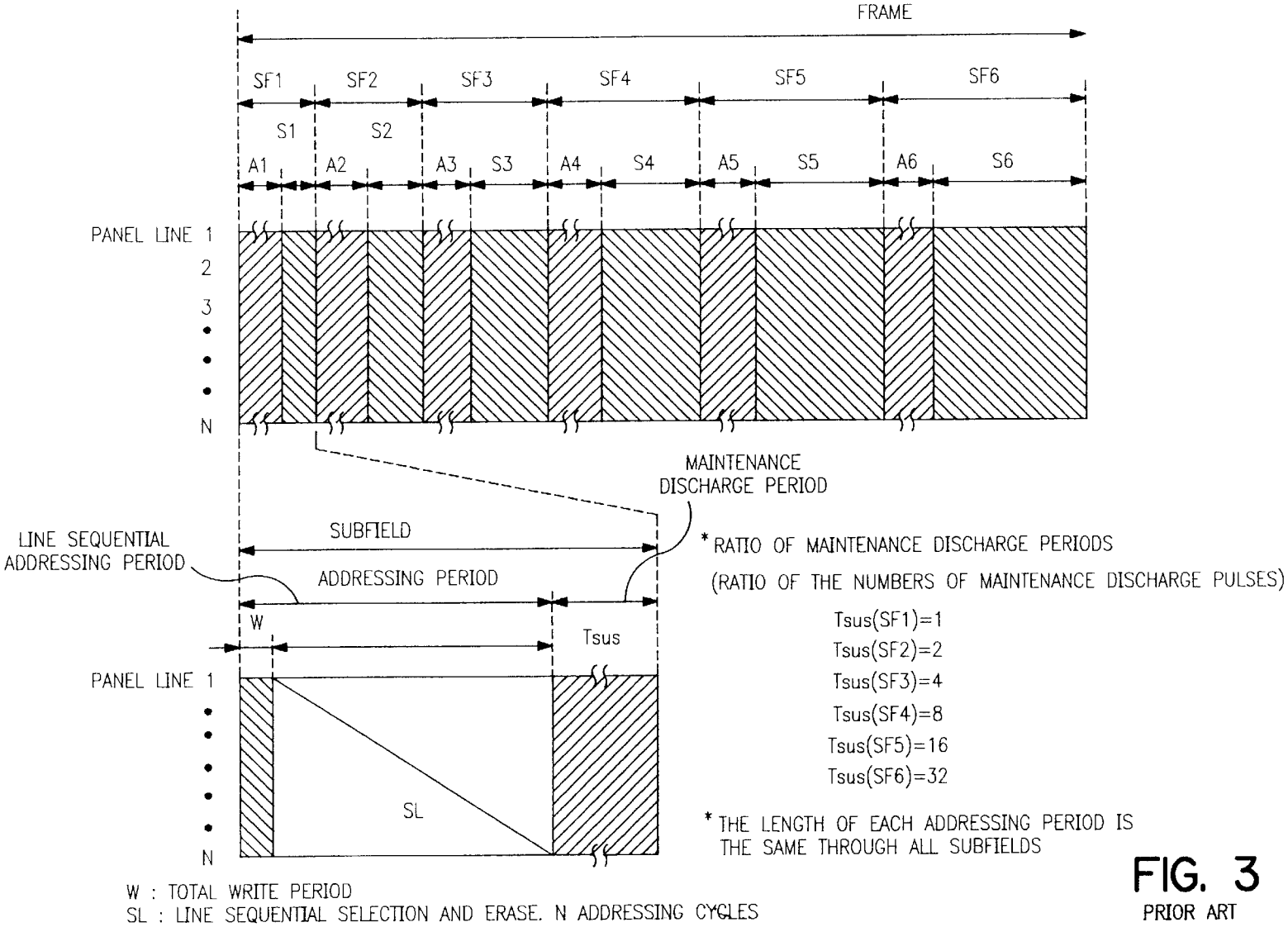
FIG. 3 PRIOR ART
FIG. 3 is a timing diagram which illustrates timing of a conventional PDP driving method employing binary codewords to achieve 64 intensity levels as is known in the prior art.

FIG. 3 illustrates the timing of a conventional PDP driving method employing binary codewords to achieve 64 intensity levels as is known in the prior art. The cell address and binary codeword value are stored in, and retrieved from, memory as Display Data. In FIG. 3, an image frame is divided into 6 subfields SF1 through SF6. The number of sustain pulses of each maintenance discharge period for a cell in the panel varies from 1, 2, 4, 8, 16, to 32 for subfields 1 to 6 respectively. Other subfield orders are possible, such as 32, 16, 8, 4, 2 to 1. Each subfield has a corresponding defined bit 0 through bit 5. Each subfield is divided into an addressing period, having a write period W and a line sequential selection and erase period SL (corresponding to the address selection and erase discharge operation), and a discharge period, also known as a maintenance discharge period, S1 through S6 (corresponding to the maintenance discharge operation) in which sustain pulses are applied to the cell to emit light. As is shown, the ratio of the number of sustain pulses, $T_{SUS}$(SFi), i=1–6, for each of the discharge periods for this scheme is 1:2:4:8:16:32.

To display an image, the required level of intensity for each of the pixels in the image on a line by line basis is determined by the Intensity Mapping Processor 102. The Plasma Display Controller 104 converts the pixel address into a cell address, and converts the intensity level into a binary codeword value. As described previously, the binary codeword value of the prior art is a 6 bit value, with each bit value enabling or disabling a corresponding one of the 6 subfields corresponding to bit 0 through bit 5.

Figure 4A:
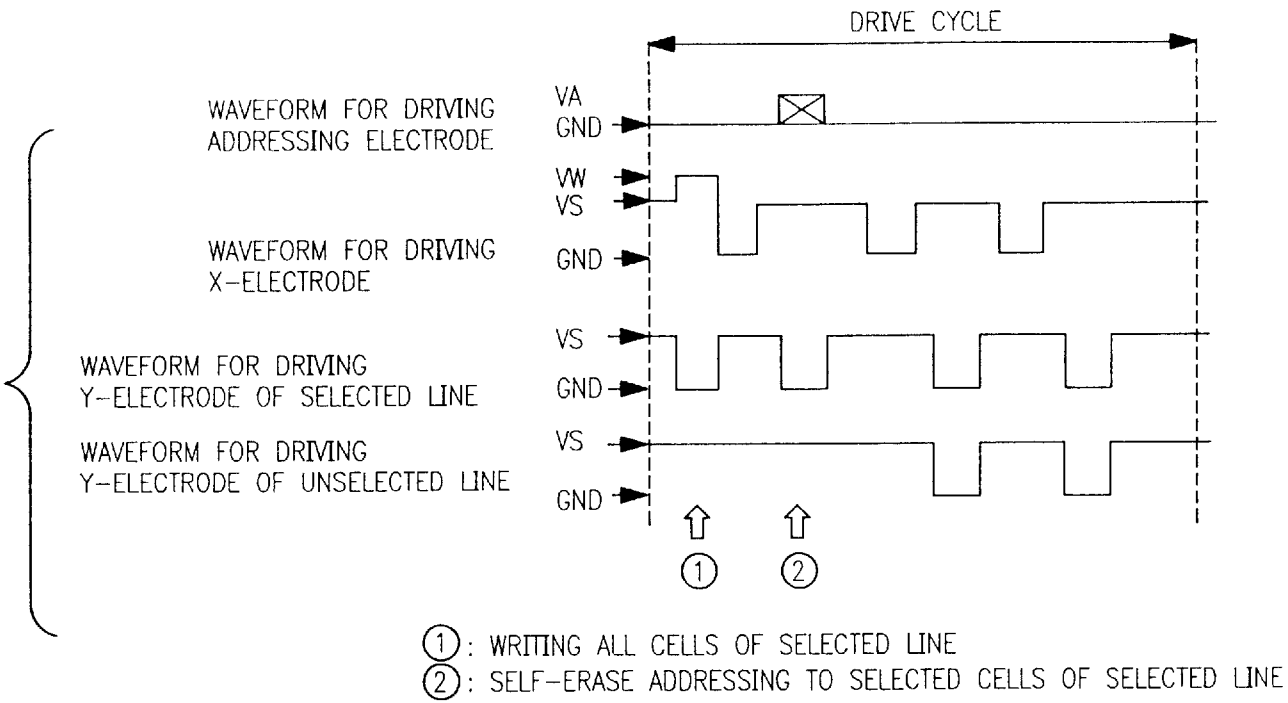
FIG. 4A PRIOR ART
FIG. 4A illustrates a timing diagram for a subfield discharge operation for an exemplary self-erase addressing method.
Figure 4B:
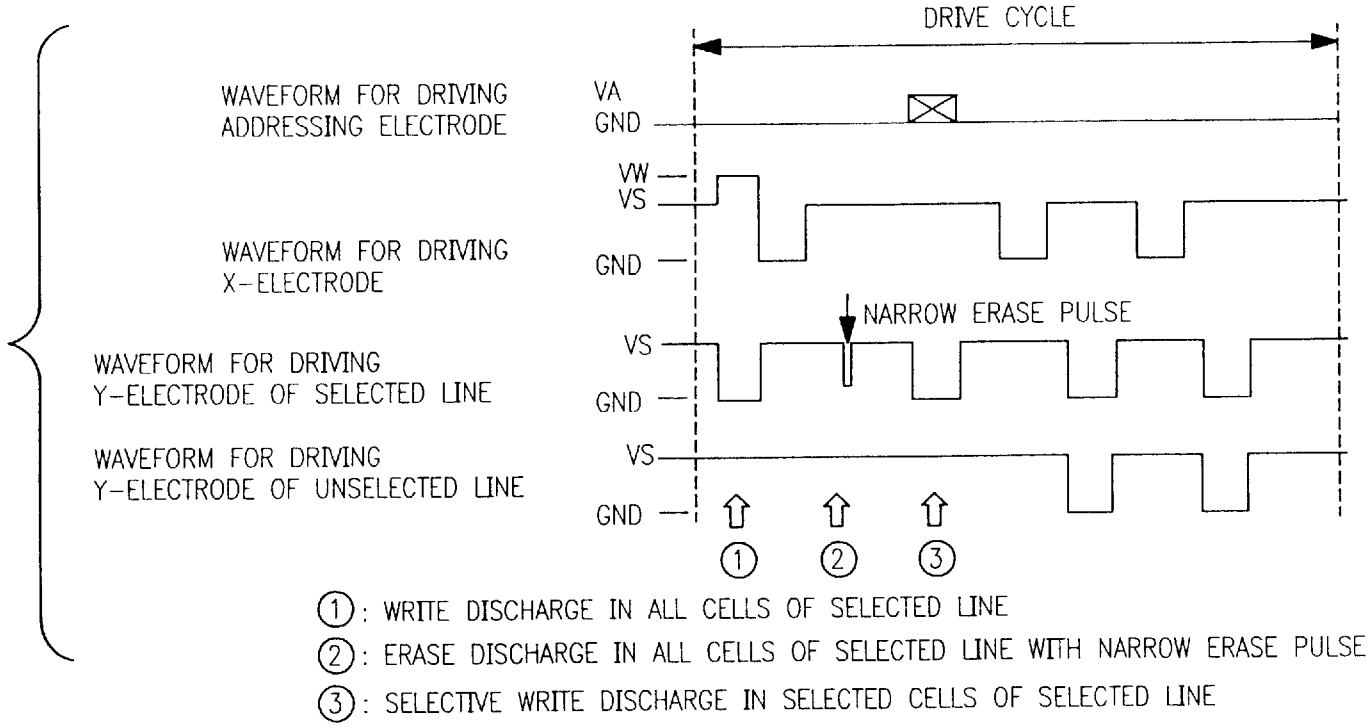
FIG. 4B PRIOR ART
FIG. 4B illustrates a timing diagram for a subfield discharge operation for an exemplary selective write addressing method.
Figure 4C:
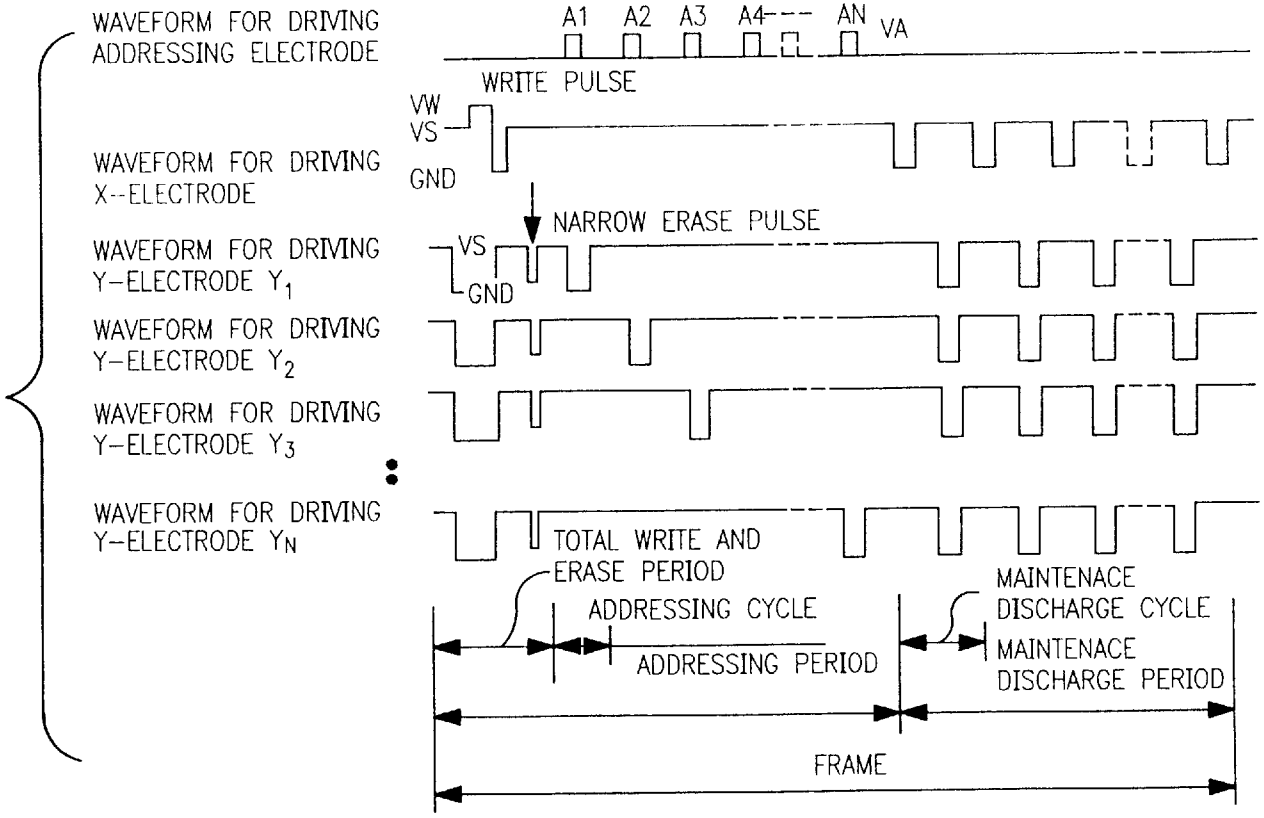
FIG. 4C PRIOR ART
FIG. 4C illustrates an alternative timing diagram for a subfield discharge operation for an exemplary selective write addressing method.

Then, for all of the display lines of the image, the corresponding cells of PDP 130 are sequentially selected for performing a subfield discharge operation. The subfield discharge operation consists of a write and erase discharge operation in which the addressing pulse is applied to the cell to enable writing data to the cell and to erase any existing wall charge in the cell, and a corresponding discharge operation in which the train of sustain pulses is applied to the cell to illuminate the pixel position and maintain wall charge. FIGS. 4A, 4B and 4C illustrate timing diagrams for the subfield discharge operation for the self-erase addressing method and the selective write addressing method, respectively. Each of these methods is described below.

Referring to FIG. 4A, an exemplary method of driving the PDP 130 as shown in FIG. 2*b* employing the self-erase addressing method is shown. A positive write pulse having a voltage of Vw is applied to the X-electrodes 7. At the same time, one of the Y-electrodes 8 corresponding to the selected display line is set to a ground level GND, and the remaining Y-electrodes 8 corresponding to unselected display lines are set to a level of Vs. As a result, a voltage between the X-electrodes 7 and the Y-electrodes 8 of the selected display line becomes Vw, and a voltage between the X-electrodes 7 and the Y-electrodes 8 of the unselected display lines becomes Vw−Vs. These voltages are set as Vw>Vf (Vf is the firing voltage which starts the discharge and Vf>>Vw−Vs). Accordingly, all cells of the selected display line start to discharge. After the discharge, an alternating voltage of Vs is applied to the X-electrodes 7 and Y-electrodes 8. At each alteration, the accumulated wall charges are enhanced by the applied voltage, and therefore, the effective voltage of the wall charges exceeds the discharge start voltage Vf, to repeat the maintenance discharges.

The cells to be erased in selected display line are first subjected to a single maintenance discharge to accumulate charge on the X electrodes 7 and Y-electrodes 8. Then, a positive addressing pulse having a voltage of Va is applied to the addressing electrodes 3 corresponding to the cells to be erased and the Y-electrodes 8 of the selected display line are set to Ground. The addressing pulse causes another single maintenance discharge of the selected display line which also causes an additional discharge between the addressing electrodes 3 and the Y-electrodes 8. Then, if a voltage Va is applied such that the accumulated wall charge in the Y-electrode exceeds the firing voltage Vf, the wall charges start a self-erase discharge once all external voltages are removed.

In FIG. 4B, the selective write addressing method writes all cells of a selected display line and then erases these cells. Thereafter, the method writes data to selected cells of the selected display line according to display data. In FIG. 4C, the cells are driven with a separate addressing period and maintenance discharge periods.

Given the plasma display device and display code scheme of the prior art, the occurrence of the contour artifact is predominantly noticed upon particular transitions between pixels. For example, if a 31 to 32 pixel intensity level transition occurs between two neighboring pixels (in either spatial or temporal direction), all the bits 0–4 except bit 5 are on for level 31 and all the bits 0–4 except bit 5 are off for level 32. Consequently this non-uniformly distributed pulse train across level 31 and 32 causes a spatial non-uniformity which is perceived by the viewer if there is relative motion between viewer and the displayed image scene. Therefore, a reduction of the spatial non-uniformity of the MPD disturbance is desirable to improve visual quality of the images displayed on the plasma display panel.

The operation of the Plasma Display Device employing the minimum distance MPD codes of an exemplary embodiment of the present invention is now described with reference to FIG. 1. The Intensity mapping Processor 102 as used with the exemplary embodiment of the present invention may include a table used to map the (decimal) pixel intensity to a MPD codeword. The PDP 130 as described employs an 8-bit plasma display system to express a 6-bit intensity images in which minimum MPD distance codewords are used to redistribute the number of sustaining pulses for given discharge periods of the subfields. Alternatively, the PDP 130 may employ a 8-bit plasma display system to express 8-bit intensity images. In this case the two LSBs of a 8-bit pixel may be rounded to make up for two additional subfields. Error diffusion techniques may be used to improve the picture quality due to LSB rounding. Both rounding and error diffusion operations can be implemented in the mapping processor 102.

Once the pixel intensities are mapped into the intensity level codewords, the Main Processor 126 receives the pixel address and the codeword for each pixel of a scan line. The Main Processor 126 determines the cell address of the PDP 130 which corresponds to the received pixel address, and then stores address and codeword for each pixel as Display Data in Frame Memory 106. The Main Processor then repeats this process for each scan line until the complete input frame is processed and stored in Frame Memory 106 as Display Data.

For the present system, the described exemplary embodiment assumes that the complete image is loaded into the PDP 130 before "firing" (i.e. applying the sustain pulses for light emission). In this situation, the Plasma Display Controller 104 receives each line of the image from the Intensity Mapping Processor 102 until the complete frame is received, and performs any subsequent processing. Once the complete frame is available in Frame Memory 106 as Display Data, called a PDP image frame, the Plasma Display Controller 104 prepares the PDP image frame for display.

Referring to FIG. 1, the Display Data Controller 120 transfers the Display Data (DAT) to the Addressing/Data Electrode Driver 132 through signals (not shown) transfer clock (TCLK) and latching signal (Latch) according to the drive timing signal PDPCLK for the PDP 130 as generated by the Clock and Synchronization Generator 108. The Panel Driver Controller 122 determines from the PDPCLK signal timing to apply the high voltage waveform to the cells of the PDP 130. In addition, the Panel Driver Controller uses this timing to also provide scan data, SCANDAT, bit by bit according to transfer clock TCLK to turn on the Scan Drivers 134 for each line of the PDP 130. The Panel Driver Controller 122 also provides signals for turning ON and OFF the X-electrodes 7 using voltage signals Vs and Vw described previously.

The Display Data Controller 120 generates addresses for reading out the Display Data from Frame Memory 106 synchronized to the high-voltage drive signals Vs and Vw for PDP 130. For the exemplary embodiment, the Display Data Controller 120 transfers the Display Data line by line, alternating the transfer to the Even Display Data Driver 150 and Odd Display Data Driver 152 respectively. Once the Display Data values for the PDP 130 are loaded for the first subfield period (SF1), the Display Data controller 120 begins driving the PDP 130 by generating a Vsync signal for the Sustain Pulse Drivers 136 to begin strobing the cells with maintenance discharge pulses for all lines concurrently. Other exemplary embodiments may strobe the lines sequentially, or alternatively by strobing the even lines first and then the odd lines.

Once the first subfield period ends, the addressing period is repeated for the next subfield, although this may not require transferring Display Data from the Frame Memory 106, the Addressing/Data Electrode Driver 132, Panel Driver Controller 122, and Display Data Controller 120 repeat the loading process of the PDP 130 with the next subfield (SF2) display data value and repeat strobing the PDP 130 by the Sustain Pulse Drivers 136. This process repeats until all subfield periods are complete.

Determination of Minimum MPD Distance Codes

The present invention employs a set of codewords which are applied to each pixel in the image to substantially eliminate the contour artifacts as much as possible, instead of scattering them randomly in an image, as is employed by systems of the prior art. To quantitatively analyze the problem of MPD, a MPD distance is defined which measures the severity of a particular contour artifact for a transition. In general, large MPD distance is an indication of the presence of more distinctive contour artifacts existing in the perceived image.

For the exemplary embodiment, a 6-bit panel with 6 subfields is expanded to include two more subfields. Accordingly, the affected data path is assumed to be expanded to 8 bits as well so as to be compatible with expanded subfields. However, one skilled in the art could easily extend this technique to other scenarios where m subfields have been expanded to m+n subfields (n>0). If two more subfields are added to a panel with 6 subfields, the corresponding sustain pulse vector of equation (1)

$$SP=[sp_1\ sp_2\ sp_3\ sp_4\ sp_5\ sp_6\ sp_7\ sp_8] \tag{1}$$

has to satisfy two conditions. The first condition is given by equation (2):

$$\sum_{i=1}^{8} sp_i = 63 \tag{2}$$

The second condition is that for every 6-bit intensity pixel $x\in[0, 63]$, there exists at least one binary codeword $B_x=[b_7\ b_6\ b_5\ b_4\ b_3\ b_2\ b_1\ b_0]$ such that equation (3) is true:

$$x=[b_7\ b_6\ b_5\ b_4\ b_3\ b_2\ b_1\ b_0]*SP^T \tag{3}$$

In equation (3), $b_i\in\{0, 1\}$ for (i=0, 1, . . . , 7) and $SP^T$ is the transpose of the SP vector. For example, SP=[12 12 8 4 2 1 12 12] satisfies both conditions.

Once SP is selected, the mapping from a 6-bit intensity pixel x to binary codewords under SP of equation (1) may then be determined, and the mapping is in general one-to-many depending on the number of additional subfields added. Appendix A shows such a mapping from x to its binary codewords under SP (i.e., [12 12 8 4 2 1 12 12]). A criterion is needed to choose a codeword with smaller MPD to express x.

The inventors have defined a MPD distance between pixel intensities i and j as a measure for the degree of a MPD artifact, which is given by equation (4):

$$d_{mpd}(B_i, B_j, SP)=|B_i-B_j|*SP^T-|i-j| \tag{4}$$

where $B_i$ and $B_j$ are the binary codewords of decimal pixel intensities i and j, respectively, under SP. For example, the binary codewords for 31 and 32 for a straight 6-bit panel (i.e., SP=[32 16 8 4 2 1]) are $B_i$=[011111] and $B_j$=[100000], respectively. Using eq.(4), the MPD distance between 31 and 32 is given by equation (5):

$$d_{mpd}=[1\ 1\ 1\ 1\ 1\ 1]*[32\ 16\ 8\ 4\ 2\ 1]^T-[31-32]=62 \tag{5}$$

For a MPD distance of 62, which is the maximum of a 6-bit panel, transition between 31 and 32 will exhibit the strongest MPD in the perceived images. In contrast, for a transition between level 30 and 31 given by (6), $$d_{mpd}=[0\ 0\ 0\ 0\ 0\ 1]*[32\ 16\ 8\ 4\ 2\ 1]^T-|30-31|=0 \tag{6}$$

there will be no MPD artifacts in this case.

The exemplary embodiment of the present invention reduces MPD by reducing MPD distances among all the possible pixel intensity transitions. To achieve this reduction, redundancy is added to the light-emission scheme. One exemplary method is to add two more subfields and redistribute the total number of sustain pulses in an optimal manner. Alternatively, one may use two subfields corresponding to the two LSBs as two redundant subfields when adding extra subfields to the existing panel is not feasible, at the expense of reducing the dynamic range of the original PDP panel.

As can be seen from Appendix A, there are approximately $2.8\times10^{28}$ possible codeword sets for the given SP. Each codeword set has 64 codewords that could be used in the light-emission scheme to express any pixel intensity from 0 to 63. One method employed by the present invention may simply randomly choose a codeword set derived from a single SP. However, good and bad codewords in the MPD distance sense are selected without discrimination in the random selection scheme. For example, the following codeword set of Table 1 is randomly selected from Appendix A:

TABLE 1

| x | $b_7\ b_6\ b_5\ b_4\ b_3\ b_2\ b_1\ b_0$ | | | | |
|---|---|---|---|---|---|
| 0 | 00000000 | 21 | 00100110 | 41 | 10010111 |
| 1 | 00000100 | 22 | 00101010 | 42 | 10011011 |
| 2 | 00001000 | 23 | 00101110 | 43 | 10011111 |
| 3 | 00001100 | 24 | 00110001 | 44 | 10100011 |
| 4 | 00010000 | 25 | 00110101 | 45 | 10100111 |
| 5 | 00010100 | 26 | 00111001 | 46 | 10101011 |
| 6 | 00011000 | 27 | 00111101 | 47 | 10101111 |
| 7 | 00011100 | 28 | 01010001 | 48 | 10110011 |
| 8 | 00100000 | 29 | 01010101 | 49 | 10110111 |
| 9 | 00100100 | 30 | 01011001 | 50 | 10111011 |
| 10 | 00101000 | 31 | 01011101 | 51 | 10111111 |
| 11 | 00101100 | 32 | 01100001 | 52 | 11010011 |
| 12 | 00000010 | 33 | 01100101 | 53 | 11010111 |
| 13 | 00000110 | 34 | 01101001 | 54 | 11011011 |
| 14 | 00001010 | 35 | 01101101 | 55 | 11011111 |
| 15 | 00001110 | 36 | 01000011 | 56 | 11100011 |
| 16 | 00010010 | 37 | 01000111 | 57 | 11100111 |
| 17 | 00010110 | 38 | 01001011 | 58 | 11101011 |
| 18 | 00011010 | 39 | 01001111 | 59 | 11101111 |
| 19 | 00011110 | 40 | 10010011 | 60 | 11110011 |
| 20 | 00100010 | | | 61 | 11110111 |
| | | | | 62 | 11111011 |
| | | | | 63 | 11111111 |

Figure 5:
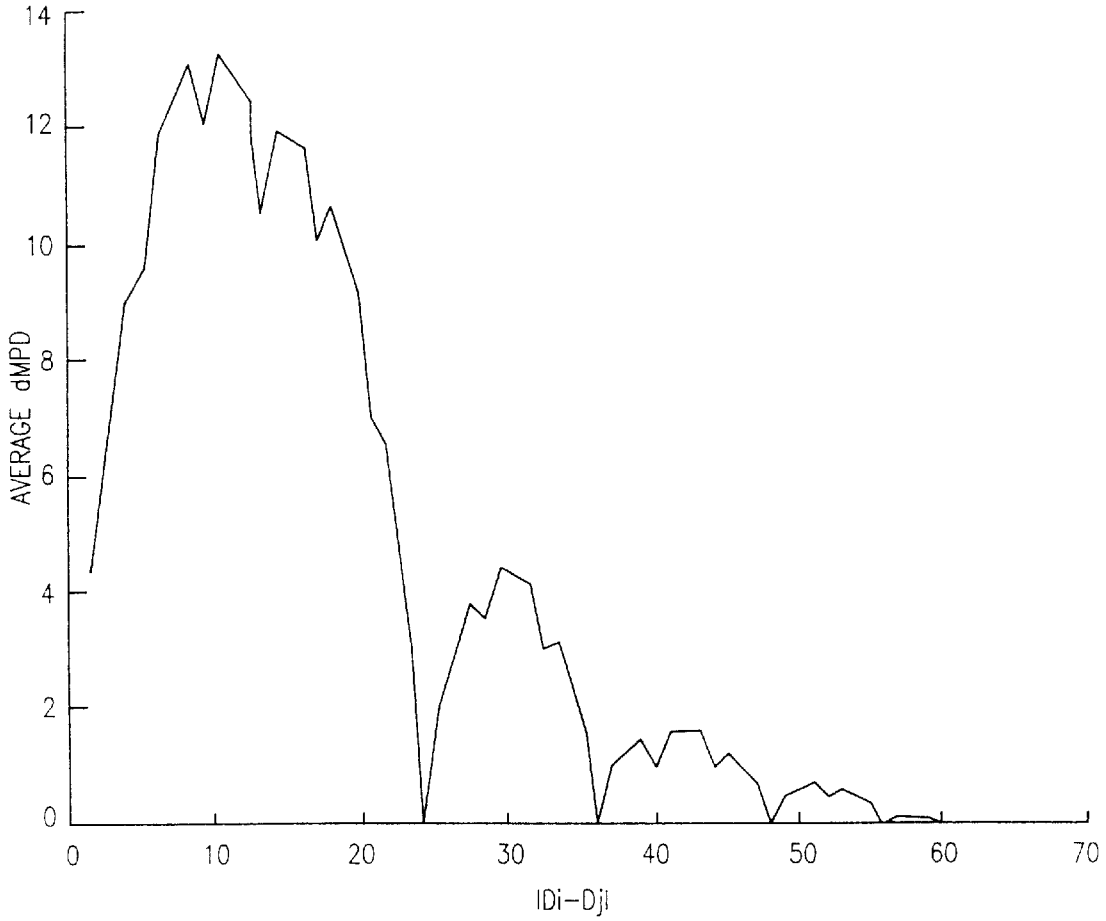
FIG. 5 illustrates an average MPD distance property for a set of exemplary codewords given in Table 1.

FIG. 5 illustrates an average MPD distance property for the exemplary codeword sets given in Table 1. The average MPD calculated based on equation (4) is defined in equation (7)

$$\overline{d}_{mpd}(\Delta) = \frac{I}{\binom{62}{\Delta}} \sum_{i=1}^{63-\Delta} d_{mpd}(B_i, B_{i+\Delta}, SP) \tag{7}$$

where $\Delta=1, 2, \ldots, 62$.

Referring to FIG. 5, the average MPD distance peaks at $\Delta=|i-j|=9$, which translates to the worst MPD artifacts (on average) occurring at level transition with pixel intensity distance of 9.

Figure 6:
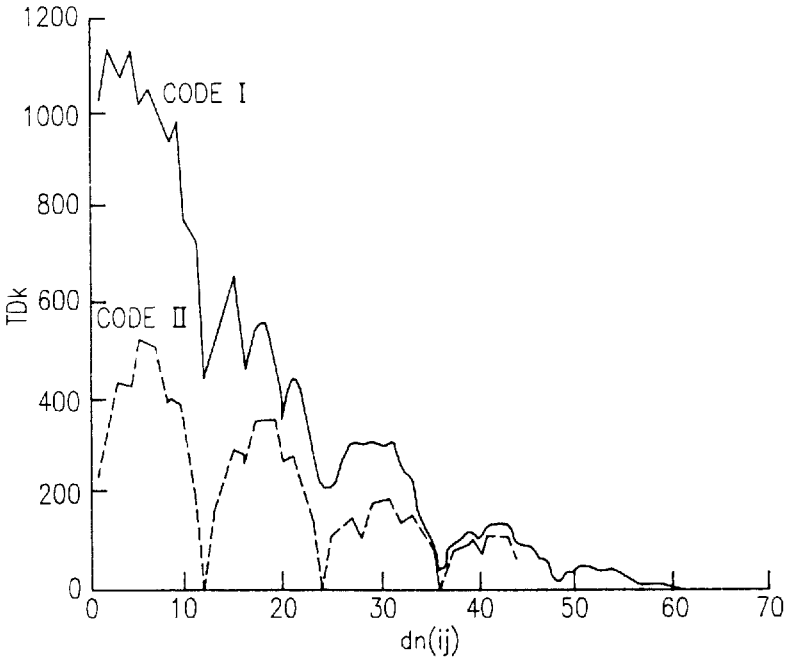
FIG. 6 is a graph illustrating a difference in MPD distance for two sets of codewords chosen from Appendix A.

The next step of the exemplary method of the present invention is to select the best codeword set from Appendix A with the minimum overall average MPD distance property. One exemplary method may be to simply compute and compare the overall average MPD distances with exhaustive or random search strategy. FIG. 6 shows two typical search results and indicates that codeword set II is better than codeword set I. Mathematically, one has to find a (binary) codeword set $\{B_k\}_{k=0}^{63}$ for pixel intensity from 0 to 63 such that equation (8) is minimized:

$$TD(SP) = \sum_{\Delta=1}^{62} \overline{d}_{mpd}(\Delta) \tag{8}$$

Minimization of equation (8) can be carried out by numerical search techniques which are well known to one skilled in the art, and may be again, for example, (i) Exhaustive search; (ii) Random search; (iii) Genetic search; or iv) Dynamic programming.

Therefore, for the exemplary embodiment of the present invention, the overall average MPD artifacts at the lowest level possible given a sustain pulse vector SP can be found from a group of binary codewords such as the exemplary group in Appendix A.

Figure 7:
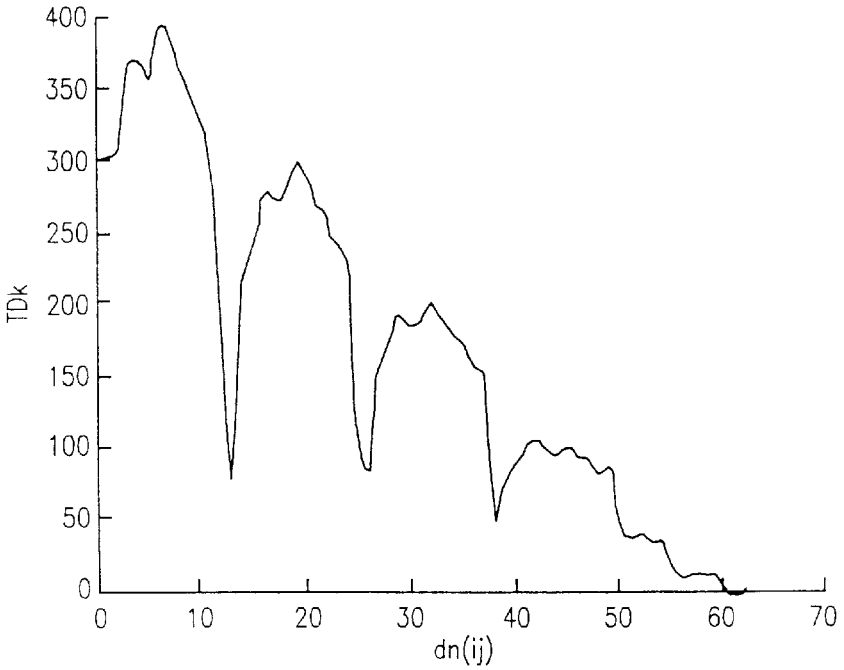
FIG. 7 is a graph illustrating an optimal set of codewords for a sustain pulse vector determined to have minimal MPD distances.

Since overall average minimum MPD distance found by applying equation (8) is limited by SP, another exemplary optimization method of the present invention involves a joint minimization of equation (8) with respect to $\{B_k\}_{k=0}^{63}$ and SP given the constraints of equations (2) and (3). Computation complexity, however, may be difficult for this method because there are millions of codes to choose from even for a fixed SP. One approach of the exemplary embodiment manually selects SP first for each test and then finds the optimal $\{B_k\}_{k=0}^{63}$ by a minimization of equation (8). For example, the inventors have determined by this method that under SP=[2 13 4 13 5 13 1 12],the resulting codeword set $\{B_k^{opt}\}_{k=0}^{63}$ gives a minimum overall average MPD distance which is illustrated in FIG. 7.

MPD Code Optimization Using Subfield Weighting

Figure 8:
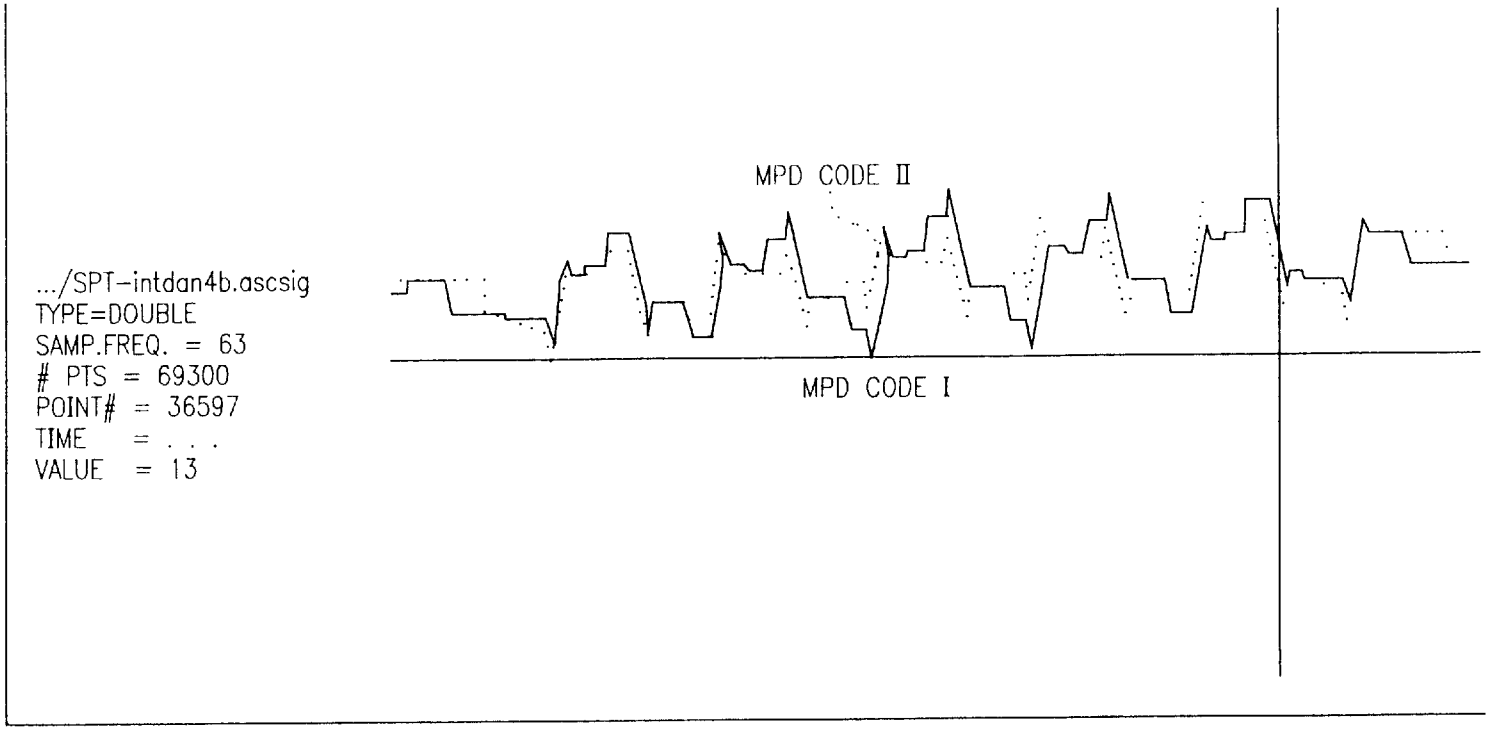
FIG. 8 shows a "close up" exemplary subfields' waveform integrated by visual perception for a ramp input signal using a MPD code with and without a weighting vector.

The worst MPD perceived in an image often occurs in the middle of the level transitions, i.e., between subfield 8 of the current frame and subfield 1 of the next frame. To further reduce the MPD artifacts visually, one can make the front portion of the codes resemble each other so as to mitigate the worst MPD spot. To accomplish this, the definition of the MPD distance measure may be modified according to the following equation (9) to form a weighted MPD distance d*:

$$d^*_{MPD}(B_i, B_j, SP) = \sum_{r=1}^{8} |B_i(r) - B_j(r)| W(r) SP(r) - d_n(i, j) \tag{9}$$

where W(r) is a weighting vector having the same number of elements as SP and $d_n(i,j)=|i-j|$. Equation (9) coincides with Equation (4) if W=[1 1 1 1 1 1 1 1]. The inventors have determined that W=(8/17) [3 11/4 5/2 9/4 2 7/4 3/2 5/4] is useful. FIG. 8 shows an exemplary waveform for a subfield integrated by visual perception for a ramp input signal using an MPD codewords with (code II) and without (code I) the weighting vector. As shown in FIG. 8, codewords with weighting has smoother level transitions than the codewords without weighting. A complete list of the exemplary codewords with weighting is shown in Table 2.

TABLE 2

| x | $b_7$ $b_6$ $b_5$ $b_4$ $b_3$ $b_2$ $b_1$ $b_0$ | | | | |
|---|---|---|---|---|---|
| 0 | 00000000 | 21 | 11001010 | 41 | 11010100 |
| 1 | 00000010 | 22 | 01101000 | 42 | 11010110 |
| 2 | 10000000 | 23 | 01101010 | 43 | 01110100 |
| 3 | 10000010 | 24 | 11101000 | 44 | 01011100 |
| 4 | 00100000 | 25 | 11101010 | 45 | 11110100 |
| 5 | 00100010 | 26 | 01010000 | 46 | 11011100 |
| 6 | 00001010 | 27 | 01010010 | 47 | 11011110 |
| 7 | 10100010 | 28 | 11010000 | 48 | 01111100 |
| 8 | 10001010 | 29 | 11010010 | 49 | 01111110 |
| 9 | 00101000 | 30 | 01110000 | 50 | 11111100 |
| 10 | 00101010 | 31 | 01011000 | 51 | 11111110 |
| 11 | 10101000 | 32 | 11110000 | 52 | 01010111 |
| 12 | 10101010 | 33 | 11011000 | 53 | 11010101 |
| 13 | 01000000 | 34 | 11011010 | 54 | 11010111 |
| 14 | 01000010 | 35 | 01111000 | 55 | 01110101 |
| 5 | 11000000 | 36 | 01111010 | 56 | 01011101 |
| 16 | 11000010 | 37 | 11111000 | 57 | 11110101 |
| 17 | 01100000 | 38 | 11111100 | 58 | 11011101 |
| 8 | 01001000 | 39 | 01010100 | 59 | 11011111 |
| 19 | 11100000 | 40 | 01010110 | 60 | 01111101 |
| 20 | 11001000 | | | 61 | 01111111 |
| | | | | 62 | 11111101 |
| | | | | 63 | 11111111 |

The exemplary embodiments of the present invention have been described with reference to a 6 bit plasma display panel with its 8-bit coding method. However, one skilled in the art would recognize that the invention may be extended to other systems, e.g. 4-bit or 8-bit systems with subfields extension other than 2.

While exemplary embodiments of the invention have been shown and described herein, it will be understood that such embodiments are provided by way of example only. Numerous variations, changes, and substitutions will occur to those skilled in the art without departing from the spirit of the invention. Accordingly, it is intended that the appended claims cover all such variations as fall within the spirit and scope of the invention.

APPENDIX A

| x | $b_7$ $b_6$ $b_5$ $b_4$ $b_3$ $b_2$ $b_1$ $b_0$ |
|---|---|
| 0 | 00000000 |
| 1 | 00000100 |
| 2 | 00001000 |
| 3 | 00001100 |
| 4 | 00010000 |
| 5 | 00010100 |
| 6 | 00011000 |
| 7 | 00011100 |
| 8 | 00100000 |
| 9 | 00100100 |
| 10 | 00101000 |
| 11 | 00101100 |
| 12 | 00000001 00000010 00110000 01000000 10000000 |
| 13 | 00000101 00000110 00110100 01000100 10000100 |
| 14 | 00001001 00001010 00111000 01001000 10001000 |
| 15 | 00001101 00001110 00111100 01001100 10001100 |
| 16 | 00010001 00010010 01010000 10010000 |
| 17 | 00010101 00010110 01010100 10010100 |
| 18 | 00011001 00011010 01011000 10011000 |
| 19 | 00011101 00011110 01011100 10011100 |
| 20 | 00100001 00100010 01100000 10100000 |
| 21 | 00100101 00100110 01100100 10100100 |
| 22 | 00101001 00101010 01101000 10101000 |
| 23 | 00101101 00101110 01101100 10101100 |

-continued

APPENDIX A

| | |
|---|---|
| 24 | 00000011 00110001 00110010 01000001 01000010 01110000 10000001 10000010 10110000 11000000 |
| 25 | 00000111 00110101 00110110 01000101 01000110 01110100 10000101 10000110 10110100 11000100 |
| 26 | 00001011 00111001 00111010 01001001 01001010 01111000 10001001 10001010 10111000 11001000 |
| 27 | 00001111 00111101 00111110 01001101 01001110 01111000 10001101 10001110 10111100 11001100 |
| 28 | 00010011 01010001 01010010 10010001 10010010 11010000 |
| 29 | 00010111 01010101 01010110 10010101 10010110 11010100 |
| 30 | 00011011 01011001 01011010 10011001 10011010 11011000 |
| 31 | 00011111 01011101 01011110 10011101 10011110 11011100 |
| 32 | 00100011 01100001 01100010 10100001 10100010 11100000 |
| 33 | 00100111 01100101 01101010 10100101 10100110 11100100 |
| 34 | 00101011 01101001 01101010 10101001 10101010 11101000 |
| 35 | 00101111 01101101 01101110 10101101 10101110 11101100 |
| 36 | 00110011 01000011 01110001 01110010 10000011 10110001 10110010 11000001 11000010 11110000 |
| 37 | 00110111 01000111 01110101 01110110 10000111 10110101 10110110 11000101 11000110 11110100 |
| 38 | 00111011 01001011 01111001 01111010 10001011 10111001 10111010 11001001 11001010 11111000 |
| 39 | 00111111 01001111 01111101 01111110 10001111 10111101 10111110 11001101 11001110 11111100 |
| 40 | 01010011 10010011 11010001 11010010 |
| 41 | 01010111 10010111 11010101 11010110 |
| 42 | 01011011 10011011 11011001 11011010 |
| 43 | 01011111 10011111 11011101 11011110 |
| 44 | 01100011 10100011 11100001 11100010 |
| 45 | 01100111 10100111 11100101 11100110 |
| 46 | 01101011 10101011 11101001 11101010 |
| 47 | 01101011 10101111 11101101 11101110 |
| 48 | 01110011 10110011 11000011 11110001 11110010 |
| 49 | 01110111 10110111 11000111 11110101 11110110 |
| 50 | 01111011 10111011 11001011 11111001 11111010 |
| 51 | 01111111 10111111 11001111 11111101 11111110 |
| 52 | 11010011 |
| 53 | 11010111 |
| 54 | 11011011 |
| 55 | 11011111 |
| 56 | 11100011 |
| 57 | 11100111 |
| 58 | 11101011 |
| 59 | 11101111 |
| 60 | 11110011 |
| 61 | 11110111 |
| 62 | 11111011 |
| 63 | 11111111 |

All the possible binary codes for $SP_a$ = [12 12 8 4 2 1 12]

What is claimed:

1. A method of displaying a sequence of video image frames on a display device, wherein a plurality of subfield periods are defined for each video image frame, each of the subfield periods having a respective illumination level which is applied to the display device, and each video image frame including a plurality of picture elements (pixels), each pixel being displayed at a respective pixel position on the display device and each pixel having a respective intensity value of a set of intensity values, the method comprising the steps of:

a) defining at least one combination of subfield periods and respective illumination levels for each one of the set of intensity values to form a set of minimum moving pixel distortion (MPD) codes so as to minimize moving pixel distortion on the display device between successive frames or within a frame;

b) mapping the intensity value of each respective pixel into a respective one of the set of minimum MPD codes; and c) displaying the sequence of video image frames by using, for each pixel, the respective combination of subfield periods and respective illumination levels produced by mapping each pixel intensity value into the respective defined one of minimum MPD codes.

2. The method of displaying a sequence of video image frames on a display device as recited in claim 1, wherein each one of the set of minimum MPD codes is a binary word having a plurality of bit values, each bit value corresponding to a respective one of the subfield periods, and each bit value indicating whether to enable application of the respective illumination level of the one of the subfield periods.

3. The method of displaying a sequence of video image frames on a display device as recited in claim 1, wherein the at least one combination for each respective one of the set of intensity values of step a) is defined by a vector value, and the set of minimum MPD codes is chosen by minimizing a distance between each vector value for all selected pairs of the set of intensity values.

4. A method of forming a set of minimum Moving Pixel Distortion (MPD) codewords from a sustain pulse vector having a first number of elements in sequence, the combination of the elements forming a maximum value, and the minimum MPD codewords being used for mapping pixels corresponding to an image frame, comprising the steps of:

a) defining a new sustain pulse vector having a second number of modified elements, the second number being at least one greater than the first number, wherein a combination of the modified elements of the new sustain pulse vector is equivalent to the maximum value;

b) defining for each one of the first number of elements in sequence a vector such that the vector in vector-combination with the new sustain pulse vector, which vector-combination is equivalent to a sum of at least one of the second number of modified elements, is equivalent to the one of the first number of elements;

c) calculating a MPD distance between a difference of selected ones of the first number of elements and a difference between each corresponding vector-combination of the selected ones of the first number of elements; and d) repeating steps a) through c) until a sum of each minimum MPD distance for all pairs of the first number of elements is minimized, and each minimum MPD codeword corresponding to a respective one of the first number of elements is the corresponding vector defined in step b).

5. The method of forming a set of minimum Moving Pixel Distortion (MPD) codewords as recited in claim 4, wherein step c) further includes weighting each vector-combination difference with a respective weighting value.

6. The method of forming a set of minimum Moving Pixel Distortion (MPD) codewords as recited in claim 4, wherein the first number of elements is selected from the group consisting of 6 for sustain pulse vector {1, 2, 4, 8, 16, 32}, 7 for sustain pulse vector {1, 2, 4, 8, 16, 32, 64} and 8 for sustain pulse vector {1, 2, 4, 8, 16, 32, 64, 128}.

7. Apparatus for displaying a sequence of video image frames on a display device, wherein a plurality of subfield periods are defined for each video image frame, each of the subfield periods having a respective illumination level which is applied to the display device, and each video image frame includes a plurality of picture elements (pixels), each pixel being displayed at a respective pixel position on the display device and each pixel having a respective intensity value of a set of intensity values, the apparatus comprising:

mapping means for mapping the intensity value of each respective pixel into a respective one of a set of minimum MPD codes, wherein at least one combination of subfield periods and respective illumination levels is defined for each one of the set of intensity values to form the set of minimum moving pixel distortion (MPD) codes so as to minimize moving pixel distortion on the display device between successive frames; and plasma display means for displaying the sequence of video image frames by using, for each pixel, the respective combination of subfield periods and respective illumination levels produced by mapping each pixel intensity value into the respective defined one of minimum MPD codes.

8. Apparatus for displaying a video image frame as a processed image frame, the apparatus comprising:

means for receiving a video signal representing the video image frame, the video signal including a plurality of lines, each line having a plurality of pixel intensity values having a corresponding pixel address;

minimum Moving Pixel Distortion (MPD) mapping means for mapping each one of the plurality of pixel intensity values to a respective one of a set of minimum MPD codeword values to form a mapped pixel value;

plasma display means for displaying the processed image frame, the plasma display means including:

a) a plasma display panel (PDP) having a plurality of cells, each cell having a cell address, b) cell addressing means for selecting one of the plurality of cells responsive to an address signal, and c) cell illuminating means for illuminating a cell responsive to a pulse signal; and control means including:

a) means for determining from the pixel address the corresponding cell address of the plasma display panel, b) means for associating for each of the plurality of pixel intensity values the corresponding mapped pixel value and the respective cell address to form a display data value, and c) means for displaying the processed image frame by selecting ones of the plurality of cells by providing the cell addressing means the addressing signal based on the corresponding cell address and mapped pixel value of each display data value, and by providing the pulse signal to the illuminating means.

9. The apparatus for displaying the video image frame as recited in claim 8, wherein the mapping means further includes means for applying an inverse gamma correction value to each one of the plurality of received pixel intensity values.

10. The apparatus for displaying the video image frame as recited in claim 8, further comprising memory means for storing each display data value corresponding to the video image frame, and the control means further includes means for retrieving each display data value from the memory means.

* * * * *